US011932437B2

(12) United States Patent
Tateossian

(10) Patent No.: US 11,932,437 B2
(45) Date of Patent: Mar. 19, 2024

(54) METHOD OF SHAPING AND COMPRESSING TOILET PAPER ROLLS

(71) Applicant: Tony Tateossian, Glendale, CA (US)

(72) Inventor: Tony Tateossian, Glendale, CA (US)

( * ) Notice: Subject to any disclaimer, the term of this patent is extended or adjusted under 35 U.S.C. 154(b) by 45 days.

(21) Appl. No.: 17/565,341

(22) Filed: Dec. 29, 2021

(65) Prior Publication Data

US 2023/0202698 A1 Jun. 29, 2023

(51) Int. Cl.

| | |
|---|---|
| ***B65B 63/02*** | (2006.01) |
| ***B65B 5/06*** | (2006.01) |
| ***B65B 11/08*** | (2006.01) |
| ***B65B 53/02*** | (2006.01) |

(52) U.S. Cl.

CPC ..... *B65B 63/026* (2013.01); *B65B 5/06* (2013.01); *B65B 11/08* (2013.01); *B65B 53/02* (2013.01)

(58) Field of Classification Search

CPC ..... B65B 63/02; B65B 63/026; B65B 53/02
See application file for complete search history.

(56) References Cited

U.S. PATENT DOCUMENTS

| | | | | | |
|---|---|---|---|---|---|
| 3,732,969 | A * | 5/1973 | Formo | B65B 35/46 | 198/721 |
| 4,001,914 | A * | 1/1977 | Riegler | A22C 13/02 | 452/25 |
| 4,004,620 | A * | 1/1977 | Rosen | B65B 57/02 | 141/137 |
| 4,095,390 | A * | 6/1978 | Knudsen | B65B 51/18 | 53/316 |
| 4,429,512 | A * | 2/1984 | Pegon, Jr. | B65B 5/101 | 53/247 |
| 4,490,962 | A * | 1/1985 | Weis | B29C 66/81422 | 156/203 |
| 4,679,379 | A * | 7/1987 | Cassoli | B65B 63/02 | 414/789.2 |
| 4,693,055 | A * | 9/1987 | Olsen, Jr. | B65B 21/06 | 53/251 |
| 4,771,589 | A * | 9/1988 | Mueller | B65B 35/54 | 53/448 |
| 5,195,300 | A * | 3/1993 | Kovacs | B65B 63/026 | 100/207 |
| 5,251,740 | A * | 10/1993 | Spatafora | B65B 63/022 | 198/456 |
| 5,282,348 | A * | 2/1994 | Dampier | B65D 71/406 | 53/413 |
| 7,104,031 | B2 * | 9/2006 | Baggot | B65B 63/02 | 53/550 |
| 2006/0130431 | A1 * | 6/2006 | Baggot | B65B 63/02 | 53/529 |
| 2014/0190126 | A1 * | 7/2014 | De Hertogh | B65G 47/71 | 53/147 |
| 2015/0203221 | A1 * | 7/2015 | Van De Hey | B65D 75/002 | 53/436 |

FOREIGN PATENT DOCUMENTS

| | | | | |
|---|---|---|---|---|
| WO | WO-03093114 A1 * | 11/2003 | | B65B 53/063 |

* cited by examiner

*Primary Examiner* — Christopher R Harmon

(57) ABSTRACT

A method of shaping and compressing toilet paper rolls using compressor rollers is disclosed. The method is comprised of a workflow that includes fluted rollers, sleeve wrapping and specific packaging procedures. An object of the method is to provide a means to reduce the size of conventional toilet paper rolls in bulk to make shipping more efficient. For example, a box that currently holds twelve rolls now can hold twice as many rolls when utilizing the disclosed method.

8 Claims, 4 Drawing Sheets

METHOD OF SHAPING AND COMPRESSING TOILET PAPER ROLLS

CROSS-REFERENCE TO RELATED APPLICATION

This application claims the benefit of Provisional Patent Application No. U.S. 63/193,758 filed on May 7 2021.

FIELD OF THE INVENTION

The present invention generally relates to a manufacturing method. More specifically, it relates to a method of shaping and compressing toilet paper rolls.

BACKGROUND

Early humans wiped themselves with wool, lace or hemp. Some cleaned themselves with various materials such as rags, wood shavings, leaves, grass, hay, stones, sand, moss, water, snow, ferns, plant husks, fruit skins, seashells, or corncobs, depending upon the country and weather conditions or social customs. In Ancient Rome, a sponge on a stick was commonly used, and, after use, placed back in a pail of vinegar. Several talmudic sources indicating ancient Jewish practice refer to the use of small pebbles, often carried in a special bag, and also to the use of dry grass. The first documented use of toilet paper in human history dates back to the 6th century AD, in early medieval China. During the early 14th century, ten million packages of 1,000 to 10,000 sheets of toilet paper were manufactured annually. During the Ming dynasty, an annual supply of 720,000 sheets of toilet paper (approximately 2 by 3 ft (60 by 90 cm)) were produced for the general use of the imperial court at the capital of Nanjing. Centuries later, with the rise of publishing by the eighteenth century led to the use of newspapers and cheap editions of popular books for cleansing. Joseph Gayetty is widely credited with being the inventor of modern commercially available toilet paper in the United States. Gayetty's paper, first introduced in 1857, was available as late as the 1920s. Gayetty's Medicated Paper was sold in packages of flat sheets, watermarked with the inventor's name. Seth Wheeler of Albany, New York, obtained the earliest United States patents for toilet paper and dispensers, the types of which eventually were in common use in that country, in 1883. Toilet paper dispensed from rolls was popularized when the Scott Paper Company began marketing it in 1890. The manufacturing of this product had a long period of refinement, considering that as late as the 1930s, a selling point of the Northern Tissue company was that their toilet paper was "splinter free". The widespread adoption of the flush toilet increased the use of toilet paper, as heavier paper was more prone to clogging the trap that prevents sewer gases from escaping through the toilet. Today toilet paper is produced on a large scale and thousands of tons of cardboard are used to transport rolls to supermarkets. As manufacturing of toilet paper became more efficient, the industry began looking at ways to decrease volume of toilet paper for packaging. United States Patent Nos. U.S. Pat. Nos. 4,762,061A and 5,195,300A compress toilet paper using flat plates. United States Patent No. U.S. Pat. No. 5,186,099A compresses toilet paper using pistons. What is needed is a method to maximize transport space, minimize packaging waste and utilize cardboard boxes more efficiently.

SUMMARY OF THE INVENTION

The device herein disclosed and described provides a solution to the shortcomings in the prior art through the disclosure of a method of compressing toilet paper rolls for packaging and shipping. The method includes a systematic means of hydraulic compression and sleeve wrapping to reduce a roll's foot print. This method allows for packing twice as many rolls into a single shipping box.

It is briefly noted that upon a reading this disclosure, those skilled in the art will recognize various means for carrying out these intended features of the invention. As such it is to be understood that other methods, applications and systems adapted to the task may be configured to carry out these features and are therefore considered to be within the scope and intent of the present invention, and are anticipated. With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention. As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present.

By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. The objects features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF THE FIGURES

The accompanying drawings, which are incorporated herein and form a part of the specification, illustrate some, but not the only or exclusive, examples of embodiments and/or features.

Figure 1:
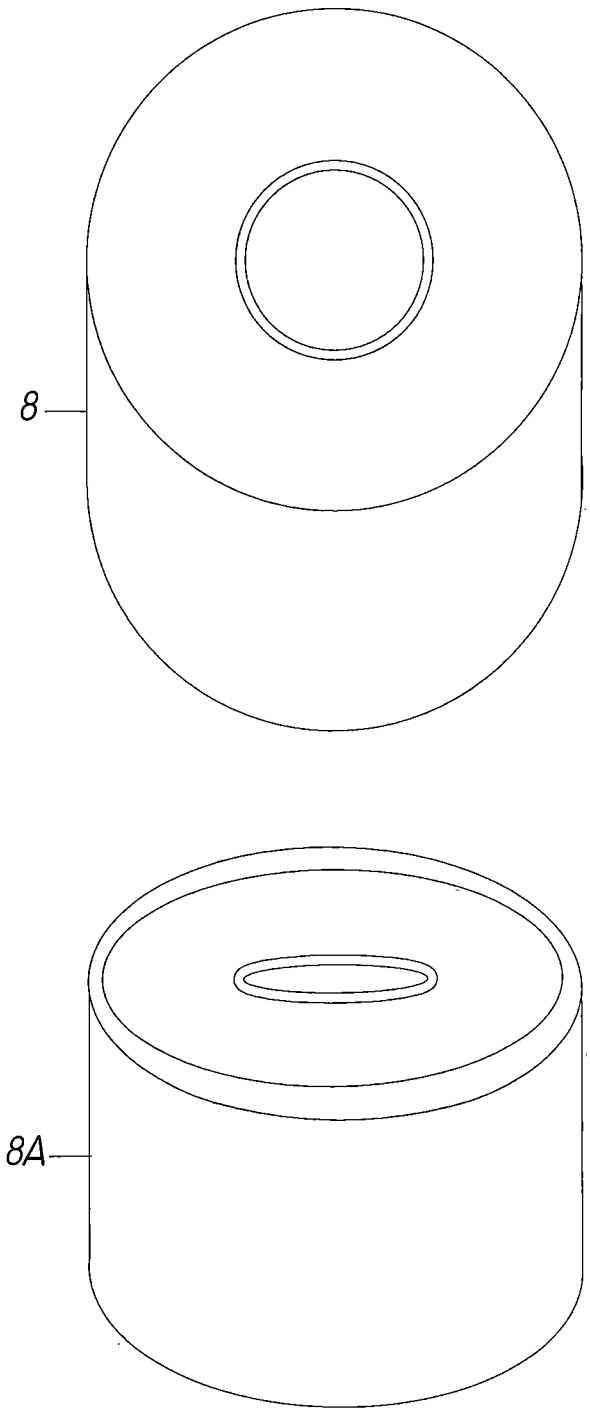
FIG. 1 shows a perspective view of a conventional and compressed roles of toilet paper.

Other aspects of the present invention shall be more readily understood when considered in conjunction with the accompanying drawings, and the following detailed description, neither of which should be considered limiting.

DETAILED DESCRIPTION OF FIGURES

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation. Conventional components of the invention are elements that are well-known in the prior art and will not be discussed in detail for this disclosure.

Figure 2:
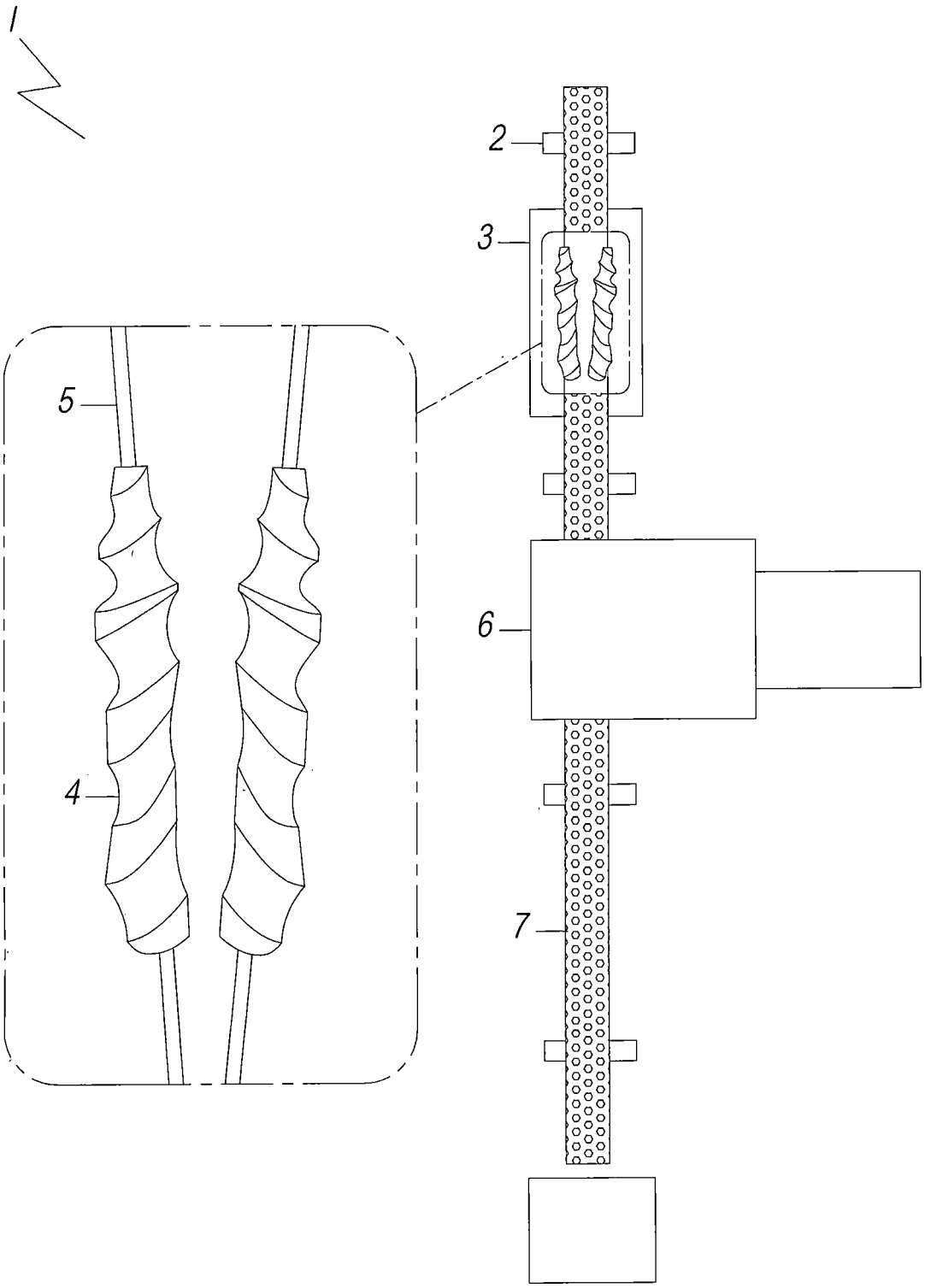
FIG. 2 shows a top view of the toilet compression method.

FIG. 1 shows a conventional roll of toilet paper 8 and a compressed roll of toilet paper 8A after being reduced by the fluted roller compression method. Said compression being but not limited to between a 20-40 percent decrease in overall height. FIG. 2 showing a top view of the fluted roller compression system 1 whereby rolls of conventional toilet paper 8 are loaded onto a conveyor system 7 having a plurality of vertical 'support spikes' and driven by bearing rollers and electrical motors and supported on posts and joists 2. The toilet paper rolls move into at least two, fluted rollers 4 which are configured adjacent to and slightly off center of one another on the longitudinal axis of the system 1. In other words, the distance between distal ends of the fluted rollers is different on each side.

Thereafter, the sleeve encased plurality of articles is sealed at its sides by heating members in combination with bottom presented anvils and the thus sealed plurality of collated articles is conveyed still on the same conveyor belt directly into a heating chamber, preferably an integral heated tunnel. In the course of passage the sleeved plurality of collated compressed toilet paper rolls 8A move through the heated tunnel, the heat sleeve film wraps tightly about the plurality of collated compressed toilet paper rolls 8A thus forming a unitized package for ease of subsequent handling and storage. Temperatures inside the sleeve wrapper are approximately but not limited to 250-275 degrees Fahrenheit. Once sleeve wrapped, the compressed toilet paper rolls 8A travel and cool along the conveyor 7 until they reach the terminal end where workers place them into boxes for final shipment.

Figure 3:
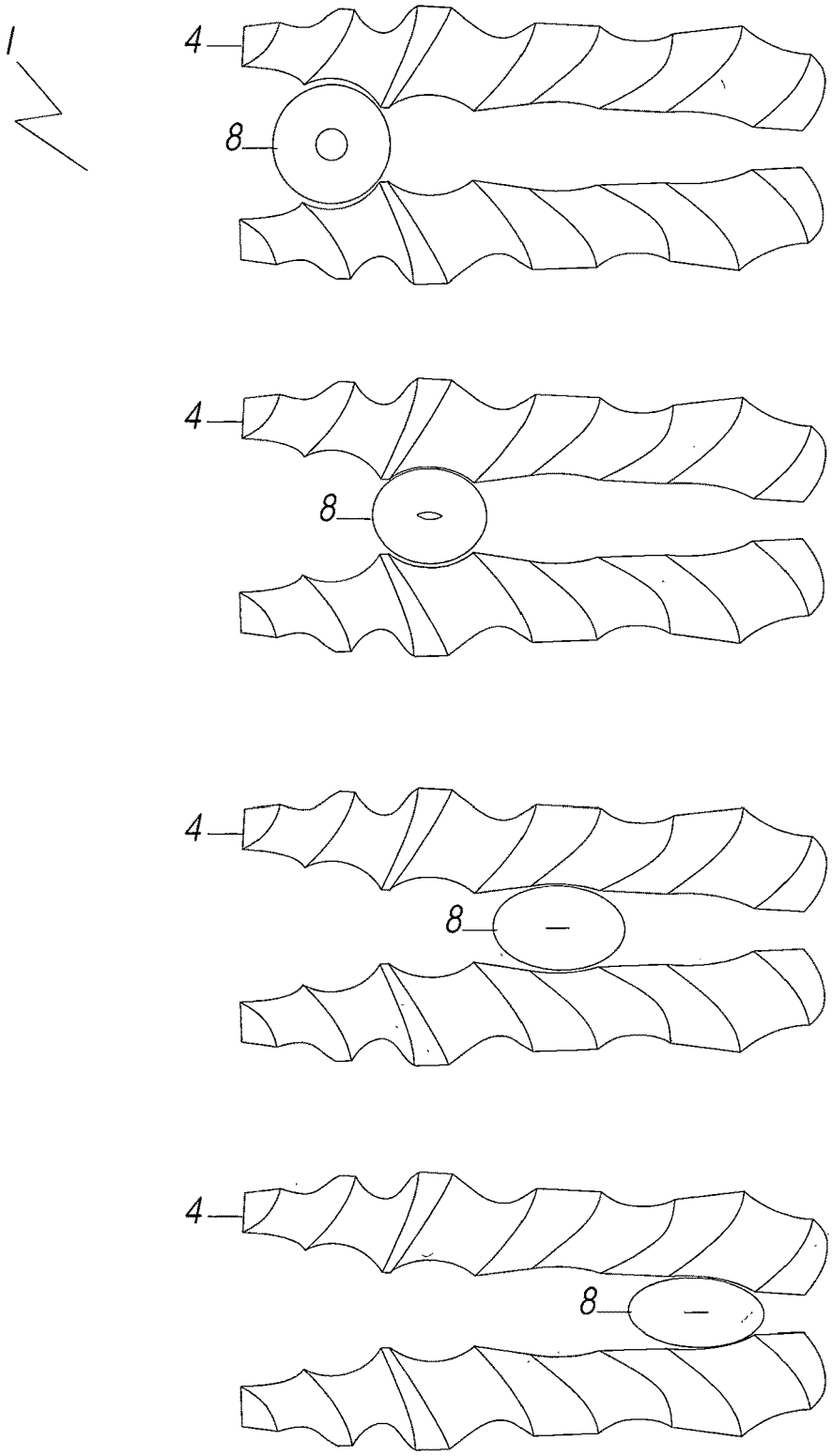
FIG. 3 shows a top view of the compression rollers
Figure 4:
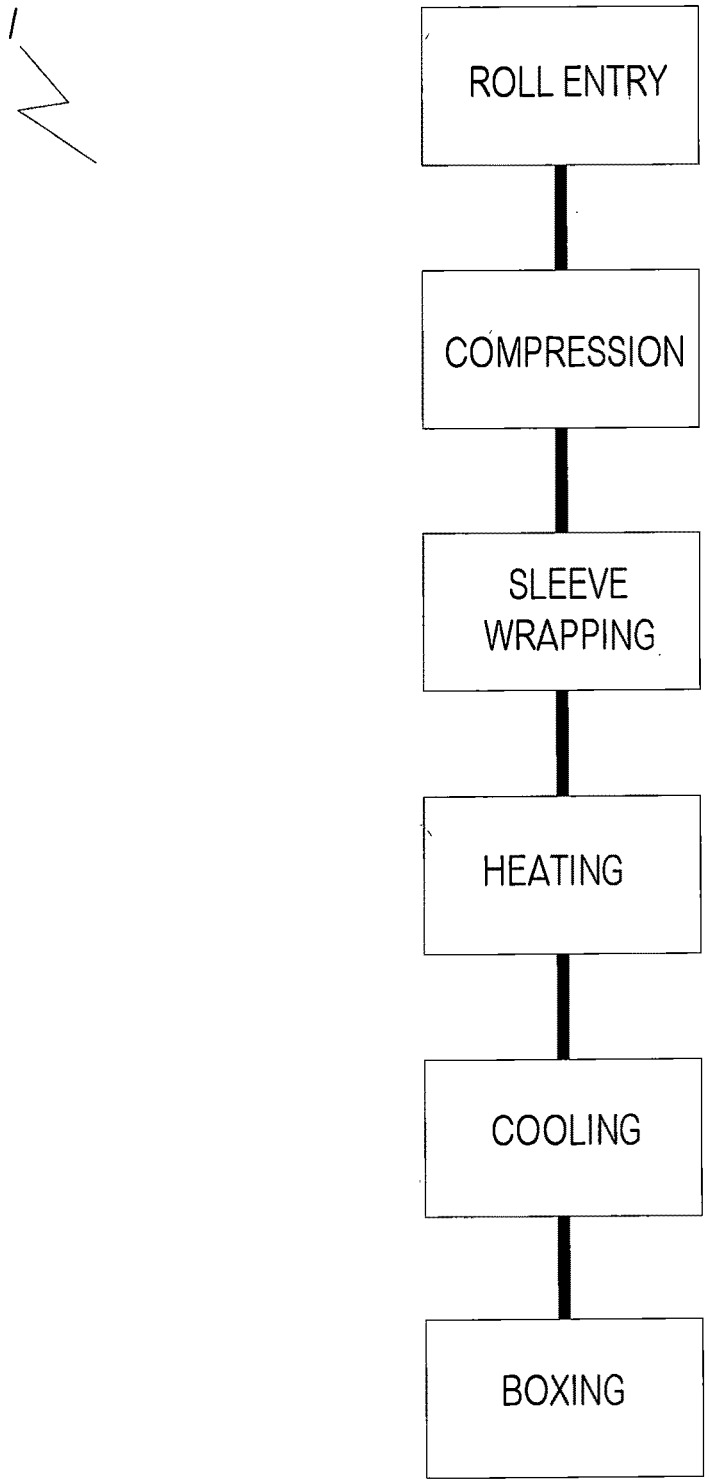
FIG. 4 shows a representative view of the method.

FIG. 3 shows various top views of the different stages of toilet paper rolls 8 as it moves along fluted rollers 4 being compressed in height inside roll entry, flute two, flute three and flute four. FIG. 4 includes a representative view of the fluted roller compression system that includes but is not limited to the following steps: rolls of toilet paper entering rotating fluted rollers on conveyor; rolls of toilet paper compressing; rolls of toilet paper entering sleeve wrapping and becoming wrapped in plastic such as polyethylene and the like; toilet paper moving and cooling along conveyor until reaching the terminal end of the conveyor and boxed.

In some embodiments, the platforms, systems, media, and methods disclosed herein include software, server, and/or database modules, or use of the same. In view of the disclosure provided herein, software modules are created by techniques known to those of skill in the art using machines, software, and languages known to the art. The software modules disclosed herein are implemented in a multitude of ways. In various embodiments, a software module comprises a file, a section of code, a programming object, a programming structure, or combinations thereof. In further various embodiments, a software module comprises a plurality of files, a plurality of sections of code, a plurality of programming objects, a plurality of programming structures, or combinations thereof. In various embodiments, the one or more software modules comprise, by way of non-limiting examples, a web application, a mobile application, and a standalone application. In some embodiments, software modules are in one computer program or application. In other embodiments, software modules are in more than one computer program or application. In some embodiments, software modules are hosted on one machine. In other embodiments, software modules are hosted on more than one machine. In further embodiments, software modules are hosted on cloud computing platforms. In some embodiments, software modules are hosted on one or more machines in one location. In other embodiments, software modules are hosted on one or more machines in more than one location.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner. While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the scope of the invention.

What is claimed is:

1. A system for shaping toilet paper rolls comprising:

a conveyor for loading toilet paper rolls;

opposing fluted compression rollers positioned with upstream ends separated by a larger distance than at downstream ends such that toilet paper rolls are conveyed and compressed in the narrowing gap between said rollers during rotation thereof;

a sleeve wrapper for enveloping the compressed toilet paper rolls and a heated tunnel for sealing the wrapped rolls.

2. The system for shaping toilet paper rolls of claim 1, wherein the conveyor comprises a plurality of vertical support spikes and is driven by bearing rollers and electrical motors.

3. The system for shaping toilet paper rolls of claim 1, wherein the fluted rollers are made of a plastic and are connected to a belt-driven electric motor for rotation.

4. A method of packaging toilet paper rolls comprising the following steps:

a) providing the system for shaping toilet paper rolls of claim 1;

b) entering toilet paper rolls between the rotating fluted rollers;

c) rotating said fluted rollers and compressing the toilet paper rolls;

d) entering the compressed rolls of toilet paper into the sleeve wrapping section;

e) wrapping the compressed rolls of toilet paper in said sleeve wrapping section;

f) heating the wrapped rolls of toilet paper in the heated tunnel;

g) cooling the toilet paper rolls along the conveyor; and h) boxing the wrapped toilet paper rolls at the terminal end of said conveyor.

5. The method of claim 4, wherein the wrapped rolls of toilet paper are heated to 250-275 degrees Fahrenheit in said heated tunnel.

6. The method of claim 4, wherein compressing said toilet paper rolls results in a 20-40 percent reduction in overall height.

7. The method of claim 4, wherein said fluted rollers are rotated in a direction toward one another.

8. The method of claim 4, wherein during wrapping of the compressed rolls, said rolls are stabilized on three sides by a pusher and movable side rails and slid through a vertically draped sheet of continuously fed sleeve wrapping.

* * * * *